US009517654B2

(12) United States Patent
Henry

(10) Patent No.: US 9,517,654 B2
(45) Date of Patent: Dec. 13, 2016

(54) WRITING IMPLEMENT

(71) Applicant: Raphael Henry, Conches (CH)

(72) Inventor: Raphael Henry, Conches (CH)

( * ) Notice: Subject to any disclaimer, the term of this patent is extended or adjusted under 35 U.S.C. 154(b) by 0 days.

(21) Appl. No.: 14/785,054

(22) PCT Filed: Apr. 24, 2014

(86) PCT No.: PCT/IB2014/000625

§ 371 (c)(1),
(2) Date: Oct. 16, 2015

(87) PCT Pub. No.: WO2014/174364

PCT Pub. Date: Oct. 30, 2014

(65) Prior Publication Data

US 2016/0082768 A1 Mar. 24, 2016

(30) Foreign Application Priority Data

Apr. 25, 2013 (CH) ..... 00861/13

(51) Int. Cl.

| | |
|---|---|
| ***G04B 19/00*** | (2006.01) |
| ***G04B 47/00*** | (2006.01) |
| ***B43K 29/087*** | (2006.01) |
| ***G04B 19/21*** | (2006.01) |

(52) U.S. Cl.

CPC ..... *B43K 29/087* (2013.01); *G04B 19/21* (2013.01); *G04B 47/00* (2013.01)

(58) Field of Classification Search

CPC ..... G04B 47/00; B43K 29/00; B43K 29/087
See application file for complete search history.

(56) References Cited

U.S. PATENT DOCUMENTS

| | | | | |
|---|---|---|---|---|
| 1,709,700 A | | 4/1929 | Wishinsky | |
| 2,107,879 A | * | 2/1938 | Tamis | B43K 29/087 401/52 |
| 2,129,480 A | * | 9/1938 | Schlacht | B43K 29/087 206/37 |
| 2,718,749 A | | 9/1955 | Florman | |

(Continued)

FOREIGN PATENT DOCUMENTS

| | | |
|---|---|---|
| FR | 2120588 | 8/1972 |
| GB | 2004096 | 3/1979 |

*Primary Examiner* — Vit W Miska
(74) *Attorney, Agent, or Firm* — Galbreath Law Offices, P.C.; John A. Galbreath

(57) ABSTRACT

The present invention relates to a writing implement comprising:

- a tubular gripping body (10) within which there is a recess for receiving an ink reservoir,
- a writing nib (12), at one end of the tubular gripping body (10) able to be connected to an ink reservoir,
- a timekeeping mechanism (14) housed in the tubular gripping body (10).

According to the invention, the timekeeping mechanism (14), housed in the tubular gripping body (10), is a mechanical movement comprising an energy source (16), a balance and hairspring (18), an escapement mechanism intermittently transmitting the energy supplied by the energy source (16) to the balance and hairspring (18), and a geartrain (20) arranged to drive a device (22) for displaying time information, said display device being visible on a circumferential portion of the tubular gripping body (10) at a position between its two ends.

11 Claims, 3 Drawing Sheets

(56) References Cited

U.S. PATENT DOCUMENTS

| | | | | | |
|---|---|---|---|---|---|
| 4,162,754 | A * | 7/1979 | Fleming | A44C 5/0046 | 224/165 |
| 4,215,531 | A * | 8/1980 | Wong | G04G 17/08 | 368/10 |
| 4,382,687 | A * | 5/1983 | Lemelson | B43K 29/087 | 368/10 |
| 4,585,364 | A * | 4/1986 | Liaw | B43K 29/087 | 346/143 |
| D354,309 | S * | 1/1995 | Lin | D10/31 | |
| 6,542,437 | B1 * | 4/2003 | Chen | G04G 17/08 | 368/10 |
| 7,102,962 | B2 * | 9/2006 | Suzuki | G04B 19/25366 | 368/37 |

* cited by examiner

WRITING IMPLEMENT

TECHNICAL FIELD

The present invention relates to the field of writing. More particularly, it relates to a writing implement comprising:

- a tubular gripping body within which there is a recess for receiving an ink reservoir,
- a writing nib at one end of the tubular body able to be connected to an ink reservoir arranged in the recess, and
- a timekeeping mechanism housed in the tubular gripping body.

PRIOR ART

The prior art already contains writing implements, pens or fountain pens connected with the field of timekeeping. In a first, purely graphical approach, the gripping body may have patterns representing timekeeping elements, such as gears, hands or watches. Also known are writing implements in which the clip that is to say the rod by means of which the writing implement can be hooked in a pocket or pouch, reproduces the shape of a tourbillon bridge. It has already been proposed to engrave a representation of a tourbillon on a cap.

More fancifully, it has also been proposed to introduce imitation parts of timekeeping mechanisms into writing implements. The purpose of this is neither to provide time information, nor to create a functioning timekeeping system.

Moreover, it is known to integrate electronic watches into pens, but the small size of electronic movements presents no problems in terms of integration.

FR941683 describes a watch-pen whose timekeeping movement is located at one end of the gripping body.

However, hitherto, constraints of construction, ergonomics or functionality have, it seems, prevented those skilled in the art from creating a writing implement integrating, within its tubular body, a completely mechanical timekeeping movement. The present invention has the object of solving this problem.

DISCLOSURE OF THE INVENTION

More precisely, the invention relates to a writing implement comprising:

- a tubular gripping body within which there is a recess for receiving an ink reservoir,
- a writing nib at one end of the tubular body able to be connected to an ink reservoir arranged in the recess, and
- a timekeeping mechanism housed in the tubular gripping body.

According to one important aspect of the invention, the timekeeping mechanism housed in the tubular gripping body is a mechanical movement comprising an energy source, a balance and hairspring, an escapement mechanism intermittently transmitting the energy supplied by the energy source to the balance and hairspring, and a geartrain arranged to drive a device for displaying time information, said display device being visible on a circumferential portion of the tubular gripping body at a position between its two ends.

BRIEF DESCRIPTION OF THE DRAWINGS

Other details of the invention will become clearer from reading the following description, with reference to the appended drawing in which.

EMBODIMENT OF THE INVENTION

Figure 1:
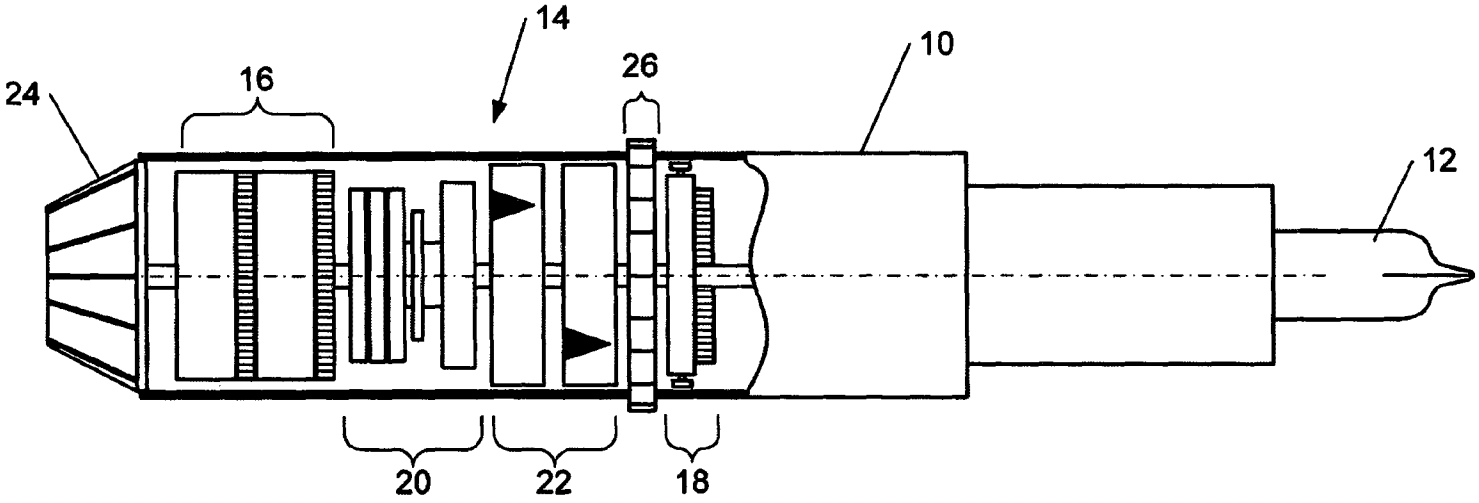
FIGS. 1, 2 and 3A-3D are diagrams which illustrate the functional principle of the invention.

Thus, the present invention relates to a writing implement, which can be a pen of any type, a fountain pen or a ballpoint pen, or furthermore a mechanical pencil. Conventionally, the writing implement according to the invention comprises a tubular gripping body 10 within which there is a recess for receiving an ink reservoir (not shown), and a writing nib 12, at one end of the tubular body 10, able to be connected to an ink reservoir arranged in the recess. A timekeeping mechanism 14 is moreover housed in the tubular gripping body 10. As will be understood hereinbelow, the timekeeping mechanism 14 is able to provide at least one indication relating to the present time, displaying hours and minutes on at least part of the circumference of the tubular gripping body 10.

The tubular gripping body 10 may have a tubular cross section of various shapes, such as for example circular, square, rectangular, cylindrical or more exotic shapes such as for example octagonal, polygonal or other even more special shapes.

More precisely, the timekeeping mechanism 14 is a complete and functioning mechanical movement, that is to say comprising an energy source 16, for example the mainspring of a barrel, a balance and hairspring 18, an escapement mechanism, not referenced, intermittently transmitting the energy supplied by the energy source 16 to the balance and hairspring 18, and a geartrain 20 arranged to drive a display device 22 by means of which it is possible to display time information, said display device being visible on at least part of the circumference of the tubular gripping body 10 at an intermediate position between these two ends.

Figures 3A, 3B, 3C, 3D:
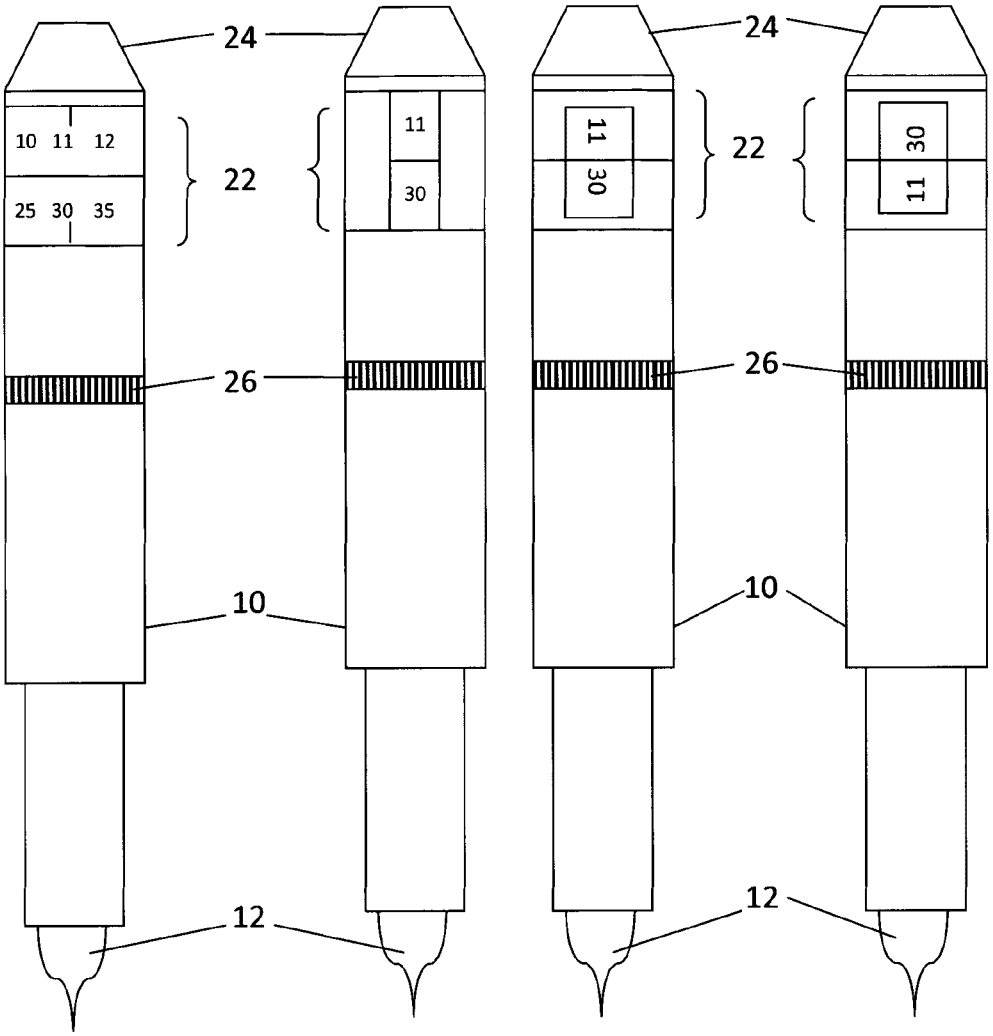

Naturally, arranging all the elements of the timekeeping mechanism in the tubular gripping body 10, in particular the display device 22 such that it remains visible, imposes a certain number of construction constraints. In one preferred embodiment, display members are mounted so as to be able to move in rotation along an annular path visible on at least part of the circumference of the tubular gripping body 10. The display members may have annular or cylindrical portions which show through behind a transparent window created in the tubular gripping body 10. Indications can be placed on the side of the annular or cylindrical portions and move with respect to a fixed marker, defining a reading zone. The writing implement can be configured such that, while a user is writing, the reading zone is directly visible. As shown, by way of example, in FIGS. 3A-3D, the display members are represented by two rollers, an hour roller and a minute roller. FIG. 3A shows a first roller on the circumferential perimeter of which is inscribed the hour value and a second roller on the circumferential perimeter of which is inscribed the minute value. The time is read from top to bottom, where the top part is the part opposite the writing nib 12. The zone for reading the time is determined by two fixed markers, such that one can read that the time is 11:30. In a variant shown in FIG. 3B, the method for reading the time is the same, with the difference that a transparent window created in the tubular gripping body 10 means that only the present time, in this case 11:30, is visibly displayed. According to another embodiment, a left-handed version, FIG. 3C, or right-handed version, FIG. 3D, can be envisaged using a particular inscription of the hour and minute values on the circumferential portion of the rollers. In each of these examples, the display is on one part of the circumference of the tubular gripping body. In the case of writing implements which require a particular orientation for writing, in particular fountain pens, the time information display can be arranged such that it is visible to the user during writing.

Also conceivable is a reverse configuration in which the display members each bear a marker which moves with respect to a scale on the tubular gripping body 10.

Advantageously, the energy source 16 is a barrel or multiple coaxial barrels, whose shaft(s) is/are mounted parallel to the longitudinal axis of the tubular gripping body 10. A system for manually winding the barrel is arranged in the tubular gripping body 10. To that end, it is possible to provide a knurled wheel 24, of annular general shape, mounted so as to be able to move in rotation on the tubular gripping body 10 and connected kinematically to the barrel (s) such that it/they can be wound. In a variant shown in FIG. 1, a second knurled wheel 26 may be arranged on the tubular gripping body 10. This second knurled wheel 26 can be connected kinematically to the display device 22 so as to set the time thereof. It is also possible to provide a safety system to prevent the second knurled wheel 26 from turning and avoid any undesired movement of the display members. This may, for example, be a pushbutton which, when actuated, frees a locking lever which otherwise prevents the second knurled wheel 26 from turning.

Figure 2:
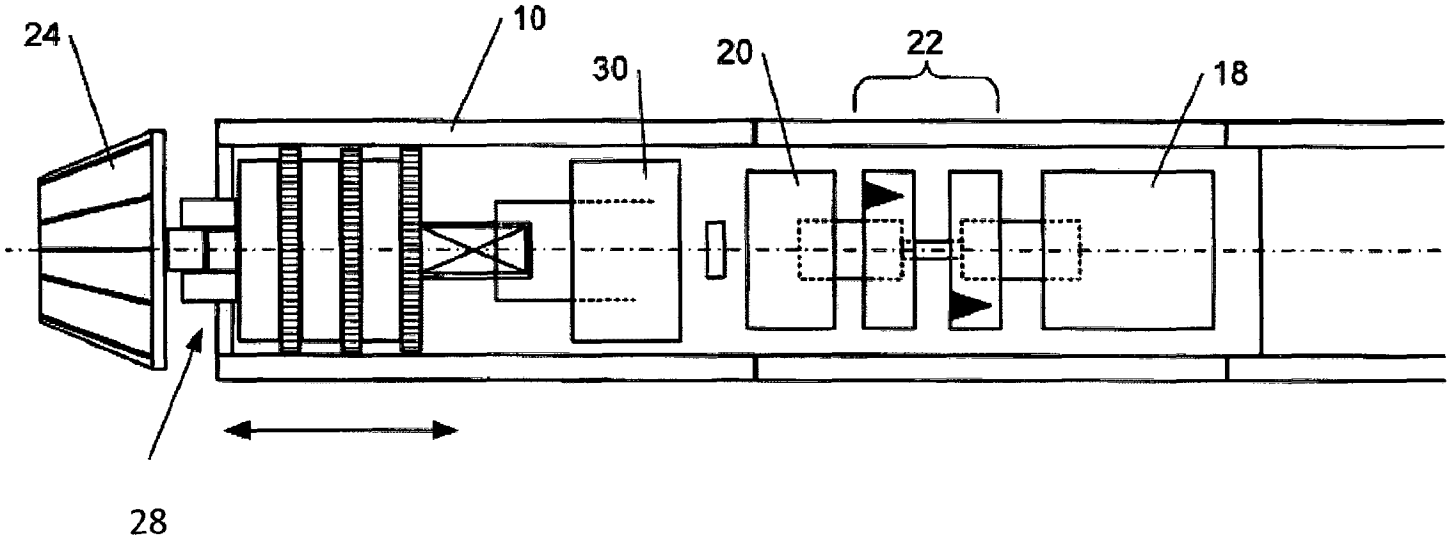

In one variant, proposed in FIG. 2, the knurled wheel 24 is mounted so as to be able to move in rotation and in translation at one end of the gripping body 10, at the opposite end from the writing nib 12. It can thus be used for winding the barrel(s) and for adjusting and setting the time of the display device 22.

The knurled wheel 24 is arranged on a control stem 28 arranged concentrically with the gripping body 10 and able to adopt at least two axial positions, a first position for winding, and a second position for setting the time of the display device 22. Thus, in a first, non-extended axial position, it is possible by means of the knurled wheel 24 to coil the barrel spring. Pulling the control stem 28 into a second axial position engages a kinematic correction chain 30, by means of which it is possible to connect the knurled wheel 24 and the display device 22 in order to set the time of the latter. A disengagement system, of the indenting type, makes it possible to move the display members without breaking or excessively disturbing the movement.

As shown in FIG. 2, which proposes a group of barrels, the latter can be mounted secured in translation with the control stem 28 and they move axially when the control stem 28 slides into its second axial position, while remaining connected to the rest of the movement.

The various wheels which form the balance and hairspring 18, the escapement mechanism and the geartrain 20 may be arranged with an axis of rotation parallel to that of the tubular gripping body 10. The movement can then be constructed vertically by stacking the various wheels. They can then be connected by their axis or by shafts mounted so as to rotate on bridges secured to the tubular gripping body 10. In such configurations, the geartrain 20 may advantageously include a differential to reduce the speed of rotation of the escapement wheel and to drive the display members at a speed corresponding to the information which they display.

The various wheels may also be arranged with an axis of rotation perpendicular to that of the tubular gripping body 10. It is thus possible to arrange the geartrain 20 in-line, in the manner of a baguette movement, fixing the frame of the movement to the tubular gripping body 10.

It is also possible to have, in the same movement, some of the wheels arranged in line with a first axis and other wheels arranged perpendicular thereto. It is then possible to provide an angled intermediate wheel between two wheels arranged in line with these two axes of rotation.

A person skilled in the art will be able to refine and specify the desired construction. On this basis, it is possible to arrange frame and support elements forming an independent movement which can be housed in and attached to the tubular gripping body 10. It is also possible to arrange frame and support elements on the tubular gripping body 10, attached thereto or made integrally therewith. The timekeeping movement is then connected kinematically to the display device 22 in order to drive the latter.

A person skilled in the art will be able to implement various variants without departing from the general scope defined by the independent claim. In particular, it is possible to implement an automatic winding system comprising a mass able to move in rotation in the tubular gripping body 10, preferably about an axis parallel to the axis of the gripping body. This oscillating mass is connected kinematically to a ratchet mounted on the barrel, in order to coil the barrel spring. Advantageously, the movements of the writing implement during use are sufficient to set in motion the oscillating mass and to wind the barrel. Although the configuration is less favorable a priori, one could even envisage implementing a mass able to move longitudinally, along the axis of the gripping body.

Similarly, the mechanical movement may show other functions such as seconds, the date or a second time zone, displayed by means of additional display members. Indeed, although the examples shown, in particular in FIGS. 3A-3D, present writing implements comprising two rollers, a first, hour roller and a second, minute roller, the mechanical movement may show other functions such as for example seconds on a third roller, the date on another roller or even a second time zone on yet another roller. The escapement mechanism may be of the Swiss lever type, mounted on a fixed frame or in a rotating cage, of the tourbillon or carousel type.

It is further to be noted that one advantageous effect of the invention is that, by virtue of the fact that the timekeeping mechanism 14 installed in the writing implement is able to adopt numerous positions in space, particularly in the use phase, the effects of gravity on the balance and hairspring assembly are averaged in the various directions, which thus makes it possible to have better precision in the operation of the timekeeping movement.

The invention claimed is:

1. A writing implement comprising:

a tubular gripping body (10) within which there is a recess for receiving an ink reservoir, a writing nib (12), at one end of the tubular gripping body (10), able to be connected to an ink reservoir arranged in the recess, and a timekeeping mechanism (14) housed in the tubular gripping body (10), wherein said timekeeping mechanism (14) housed in the tubular gripping body (10) is a mechanical movement comprising an energy source (16), a balance and hairspring (18), an escapement mechanism intermittently transmitting the energy supplied by the energy source (16) to the balance and hairspring (18), and a geartrain (20) arranged to drive a device (22) for displaying time information, said display device being visible on a circumferential portion of the tubular gripping body (10) at a position between its two ends, and wherein the display device (22) comprises display members that are mounted so as to be able to move about an axis of rotation which coincides with the longitudinal axis of the tubular gripping body (10), the display members being mounted so as to be able to move along an annular path around at least part of the circumference about the tubular gripping body (10), said display members as they move along said annular path being visible on at least a part of the circumference about the tubular gripping body 10.

2. The writing implement as claimed in claim 1, characterized in that said display members comprise at least one roller mounted in the tubular gripping body (10).

3. The writing implement as claimed in claim 2, characterized in that said display members comprise a plurality of rollers bearing different time indications visible on at least part of the circumference of the tubular gripping body (10).

4. The writing implement as claimed in claim 1, in which the energy source (16) is a barrel and characterized in that it comprises a system for manually winding the energy source (16) actuated by a first knurled wheel (24) mounted so as to be able to move on the tubular gripping body (10).

5. The writing implement as claimed in claim 4, characterized in that said first knurled wheel (24) is mounted so as to be able to move at one end of the tubular gripping body (10), at the opposite end from the writing nib (12).

6. The writing implement as claimed in claim 4, characterized in that it further comprises an automatic winding system comprising a mass which is able to move in rotation in the tubular gripping body (10) and is connected kinematically to a ratchet mounted on the barrel.

7. The writing implement as claimed in claim 1, characterized in that the geartrain (20) includes a differential to reduce the speed of rotation of an escapement wheel of said escapement mechanism and to drive the display members at a lower speed corresponding to the information which they display.

8. The writing implement as claimed in claim 1, characterized in that the movement comprises wheels arranged with an axis of rotation parallel to the axis of the tubular gripping body (10) or with an axis of rotation perpendicular to that of the tubular gripping body (10), with an angled intermediate wheel.

9. The writing implement as claimed in claim 4, characterized in that the first knurled wheel (24) for manual winding is arranged on a control stem (28) able to adopt at least two axial positions, a first position for winding, and a second position for setting the time of the display device (22).

10. The writing implement as claimed in claim 9, characterized in that the barrel is mounted secured in translation with the control stem (28).

11. The writing implement as claimed in claim 4, characterized in that it comprises a second knurled wheel (26) arranged on the tubular gripping body (10) and able to be connected kinematically to the display device (22) so as to set the time thereof.

* * * * *